US006166307A

United States Patent [19]

Caulkins et al.

[11] Patent Number: 6,166,307

[45] Date of Patent: Dec. 26, 2000

[54] APPARATUS FOR AUTOMATING A STRINGED INSTRUMENT

[76] Inventors: Kenneth B. Caulkins; Jeffrey M. Caulkins, both of 4218 Jessup Rd., Ceres, Calif. 95307

[21] Appl. No.: 09/192,441

[22] Filed: Nov. 16, 1998

[51] Int. Cl.[7] ..... G10F 1/16; G10F 1/20; G10G 7/02

[52] U.S. Cl. ..... 84/50; 84/6; 84/7; 84/454; 84/455; 84/646; 84/DIG. 30

[58] Field of Search ..... 84/7–8, 50, 315, 84/320–321, 454–455, 644–646, DIG. 30, 6

[56] References Cited

U.S. PATENT DOCUMENTS

| | | | |
|---|---|---|---|
| 5,038,657 | 8/1991 | Busley | 84/455 |
| 5,095,797 | 3/1992 | Zacaroli | 84/455 |
| 5,393,925 | 2/1995 | Wilson . | |

*Primary Examiner*—Stanley J. Witkowski
*Assistant Examiner*—Marlon T. Fletcher
*Attorney, Agent, or Firm*—Miles & Stockbridge P.C.; William L. Feeney

[57] ABSTRACT

An automated stringed musical instrument including a device for plucking the strings of the instrument, a device for fretting the strings, and a tension-maintaining linkage for maintaining the tension in the strings, such that the instrument can be remotely operated for extended periods of time without the need for operator control or re-tuning the strings.

19 Claims, 5 Drawing Sheets

APPARATUS FOR AUTOMATING A STRINGED INSTRUMENT

BACKGROUND OF THE INVENTION

1. Field of the Invention

The present invention relates to automatically plucking the strings of a stringed instrument. More specifically, it relates to automatically plucking strings that are being automatically fretted so that more than one note is sequentially sounded on a given string. Even more specifically, it relates to an actuating arm driven by a motive device operable for automatically plucking a string of a stringed musical instrument.

2. Description of Related Art

Mechanically automated musical instruments have been in use for some time, and percussion instruments such as pianos, accordions, drums, marimbas, cymbals, etc., as well as wind instruments such as organs and calliopes have traditionally been the object of automation, while the automation of stringed instruments presents a unique challenge to be discussed in detail, below.

The means for automation has evolved with changing technology. For example, for well over a century automated pianos known as player pianos have used a pneumatic actuator, sometimes called a "pneumatic", to strike a piano key when a hole assigned to that key is sensed in a moving paper tape known as a piano roll. The piano roll has a series of holes corresponding to the notes of the piano which are to be played, and one can change piano rolls in order to change songs. The piano roll is made to pass over a tracker bar which has a row of holes corresponding to all of the possible hole positions across a single row on the piano roll. Coincidence of any piano roll hole passing over a corresponding tracker bar hole causes a respective pneumatic to depress a piano key. The use and operation of such player pianos is well known and described for example in the present inventor's prior U.S. Pat. No. 4,619,177 issued Oct. 28, 1986, entitled MUSICAL INSTRUMENT PNEUMATIC ACTUATOR, and hereby incorporated by reference.

With the advent of the computer and a musical instrument digital interface, termed "MIDI", the roll can be replaced by instructions stored in the computer memory. The instructions cause electronic signals to be sent over a data cable between a MIDI connection located in the computer and a corresponding connections located in the instrument. The MIDI connection includes an electronic communications protocol for translating computer instructions and data into specific channels directed to each instrument to be automated, and further directed to each note to be sounded in a particular instrument. MIDI connections are commonly used to operate electronic instruments such as an electronic piano, wherein the notes are produced by signals synthesized and shaped to reproduce musical sounds through a sound system. In the case of player pianos and other automated acoustic instruments, i.e., instruments other than electronic keyboards, the signals received at the instrument end cause each pneumatic to be turned on and off, as appropriate to the desired music. As discussed in the present inventor's co-pending patent application Ser. No. 08/932,380, entitled MAGNETIC VALVE SYSTEM, and hereby incorporated by reference, the traditional piano roll and the alternative MIDI interface each have their benefits and drawbacks, some of which determine subtle characteristics of the musical sound produced by the instrument.

Turning to the more difficult task of automating of a stringed instrument, a satisfactory means for automating the sounding of the strings of a stringed musical instrument has eluded manufacturers of automated musical instruments, regardless of the means for storing the recording of the notes to be played, i.e., paper tape or MIDI-based computer memory. While the strings of all stringed instruments have pre-set lengths and tensions and are either struck or plucked, the strings of some instruments such as the non-pedal harp and the dulcimer are sounded simply by respectively plucking and striking the string as it is found, while the sounding portion of the strings of guitars and banjos is often simultaneously shortened by pressure against the string, while the string is being sounded. In such instruments, the neck of the instrument, which is located beneath the strings, provides a flat surface against which the musician can individually press each string at a selected location along the length of the string, so that the sounding portion of the string is shortened to achieve a desired note. This procedure, sometimes referred to as "fretting", temporarily shortens the portion of the string that is free to vibrate after the string is plucked. The sound produced by the vibrating string can be allowed to continue for a desired length of time, after which the pressure holding the string against the surface of the neck is released and another position on either the same or a different string is selected and pressed, so that another note can be sounded when plucked.

Inherent to the automation of any instrument is the requirement that the instrument be available to operate without human operation. A separate, but important condition is that the instrument should not require frequent tuning.

Put differently, when simply turned on, the automated instrument should reproduce music adhering to desired standards of tone, tuning, and other parameters particular to the type of instrument and style of music being played. As is commonly known, whenever departure from such parameters occurs, the resulting music is likely to fall short of the listener's expectations and pleasure, e.g., the notes sound "sour" or "tinny", etc. Consequently, while control of all of the parameters described herein is not essential to a rudimentary automated stringed musical instrument, the quality of music reproduction produced by the instrument strongly relates to which parameters are controlled and how that control is achieved.

One such parameter is the maintenance of proper tension in the strings, i.e., the stringed instrument must remain "in tune". As is commonly known, stringed instruments rarely retain their tuning for extended periods of time for a variety of reasons, including the selection of materials used for construction of the instrument and the design of the instrument, as well as the temperature and humidity of the surrounding environment each the time the instrument is played. Musicians typically assess the tuning of the strings at the start of each day's playing and once having tuned the instrument, typically have to readjust the tuning over a period of several hours as tension in the strings continually changes away from the initial setting. Accordingly, while an automated stringed musical instrument can be effective for a period of time without automatic maintenance of the desired tuning point of each string, such automatic tuning is a necessity for achieving quality musical sound over a substantially long period of time.

In a typical instrument, the tension in a string is set in response to rotation of a respective shaft that is rotationally mounted at one end of the string, and is arranged so that the string wraps around the shaft so that the string becomes tensioned by rotation of the shaft.

It is therefore a principal object of the present invention is to provide an automated means for individually plucking each string of a musical instrument.

Another object of the present invention is to provide an automated means for individually fretting each string of the musical instrument to shorten the sounding portion of the string.

A still further object of the present invention is to provide an automated means for individually maintaining a pre-set tension in each string of the musical instrument over substantially long periods of time.

SUMMARY OF THE INVENTION

The above and other objects of the present invention are achieved in the present invention by providing an automated device for plucking the strings of a stringed musical instrument. A second embodiment of the present invention includes an automated device for fretting the strings of a stringed musical instrument, and a third embodiment of the present invention includes a tension-maintaining linkage for maintaining the tension in a string of an automated stringed musical instrument such that the instrument can be operated for extended periods of time without the need for re-tuning the strings. The automated stringed musical instrument of the present invention is envisioned as any of these three embodiments, taken individually or in combination, depending on the degree of sophistication of automation desired.

Remote control of the playing of a stringed musical instrument can be accomplished by the automated string-plucking linkage of the present invention. A commonplace stringed instrument has tone-sounding strings held in lengthwise tension above a longitudinal surface of an underlying neck. Automation of the plucking of these strings is accomplished by a string-contacting portion rotationally indexed by an actuator. The actuator is attached to the string-contacting portion by a driving arm and includes an actuator arm that reciprocates. The driving arm is pivotally mounted relative to the actuating arm and to a respective string for cyclic oscillating movement. The string-contacting portion also includes a wheel that is rotationally mounted relative to a respective string and is rotationally connected to the driving arm through a one-way clutch, such that cyclic pivotal oscillating motion of the driving arm in opposite directions is transmitted to the wheel as periodic unidirectional rotation through the one-way clutch.

The wheel includes a plurality of blades arranged around its outer circumference. Each blade is oriented in a radial direction relative to a center of the wheel and is parallel to a rotational axis of the wheel. The wheel is mounted over a respective string so that when the wheel incrementally rotates, a free end of each blade travels in an arc that intersects the respective string so that the broad, flat surface of the blade plucks the string as it sweeps by.

The wheel further includes a plurality of contiguous flat surfaces arranged around is outer circumference and a blade is located the intersection of each pair of flat surfaces. Preferably, two flat resilient portions are arranged diametrically across from each other so that they resiliently press sequentially against each of the flat surfaces as The wheel rotates. The resilient portions function as springs and the force applied to the flat surfaces acts to brake the rotational movement of the wheel.

In another embodiment of the present invention, the remote control of the playing of the instrument includes a fretting device that selectively depresses pre-determined locations along the length of each string against an adjacent surface of the neck of the instrument. The neck has a plurality of through-holes oriented perpendicular to the surface of the neck so that each hole is disposed near a string and at spaced locations along the string. A rod-like member is arranged to slide within each hole such that a right-angled hooked end of the rod disposed above a string will draw the string down and press it against the neck surface. The rod-like member is made to move by attaching it to a remotely operated actuator shaft.

In still another embodiment of the present invention, the remote control of the playing of a stringed musical instrument includes a device for maintaining a pre-set tension in the strings of the instrument. The automation of the tensioning of the strings is accomplished by a weighted tensioning linkage attached to each string so that a predetermined tension is maintained in the string. While the string tensioning mechanism of the present invention includes the attachment and wrapping of a string around a respective shaft, the above-described rotational resistance device that resists unwinding, is absent. Ordinarily, such a shaft would include a rotational resistance device that prevents the shaft from unwinding after being set to a desired string tension. In the present invention, the shaft is arranged to rotate freely and a radius arm is attached at an outer end of the shaft so that a weight suspended from a point at a selected radius from an axis of rotation of the shaft will tend to rotate the shaft, i.e., the downward force of the weight will twist the shaft in a string-tensioning direction. Because a string can be selected that will substantially resist becoming stretched under the tensioning conditions of the instrument, and because the force of gravity is constant, a desired tension can thus be maintained in the string over a relatively long period of time.

BRIEF DESCRIPTION OF THE DRAWINGS

These and other features of the present invention and the attendant advantages will be readily apparent to those having ordinary skill in the art and the invention will be more easily understood from the following detailed description of the preferred embodiment taken in conjunction with the accompanying drawings wherein like reference characters represent like parts throughout the several views.

DETAILED DESCRIPTION OF THE PREFERRED EMBODIMENT

Figure 1:
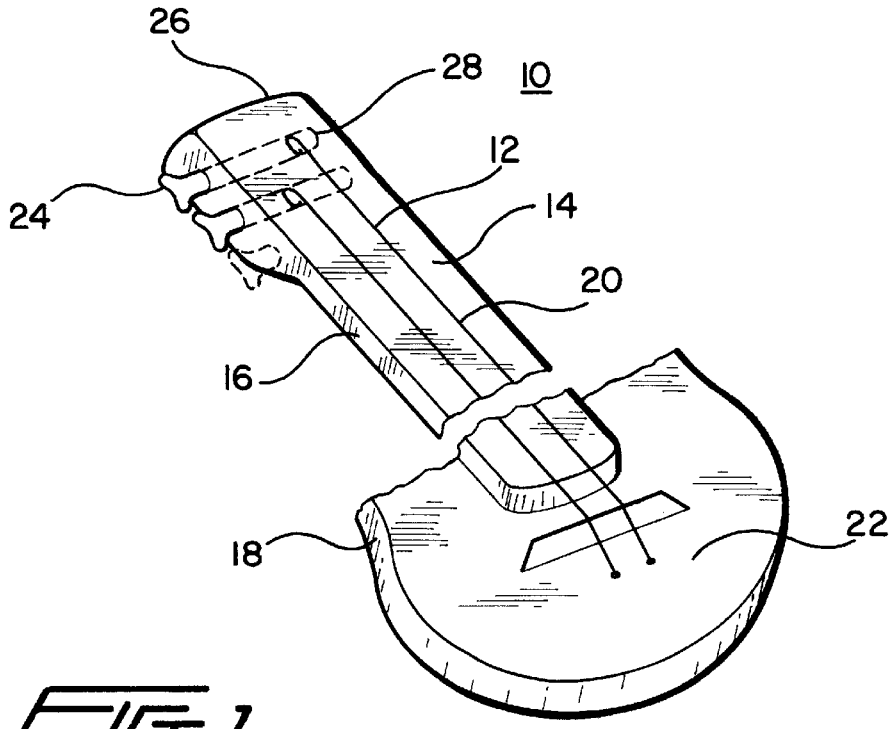
FIG. 1 (PRIOR ART)
FIG. 1 shows a prior art stringed musical instrument.

With reference to the accompanying drawings, FIG. 1 shows a prior art stringed musical instrument 10 having tone-sounding strings 12 held in tension above a longitudinal surface 14 of an underlying neck 16, which is attached to the instrument body 18. Pre-selected positions, sometimes called "fret points", or frets 20, are arranged at specified intervals along the surface of the neck 14. The strings 12 are anchored to the body 16 of the instrument 10 at a first end 22 of the body 18 and are attached to respective tensioning pegs 24 arranged to be rotationally anchored at the second end 26 of the body 18. The rotational axis of the tensioning pegs 24 is parallel to the surface 114 fictionally retained against rotation in respective through-holes 28, which may include a rotational resistance mechanism (not shown), in the neck 16. The tension of each string 12 can be adjusted by twisting the respective tensioning peg 24 until the retaining friction is overcome and the desired tension is obtained. Any particular tension enables the string 12 to produce a particular musical tone, when plucked or struck.

Figure 2A:
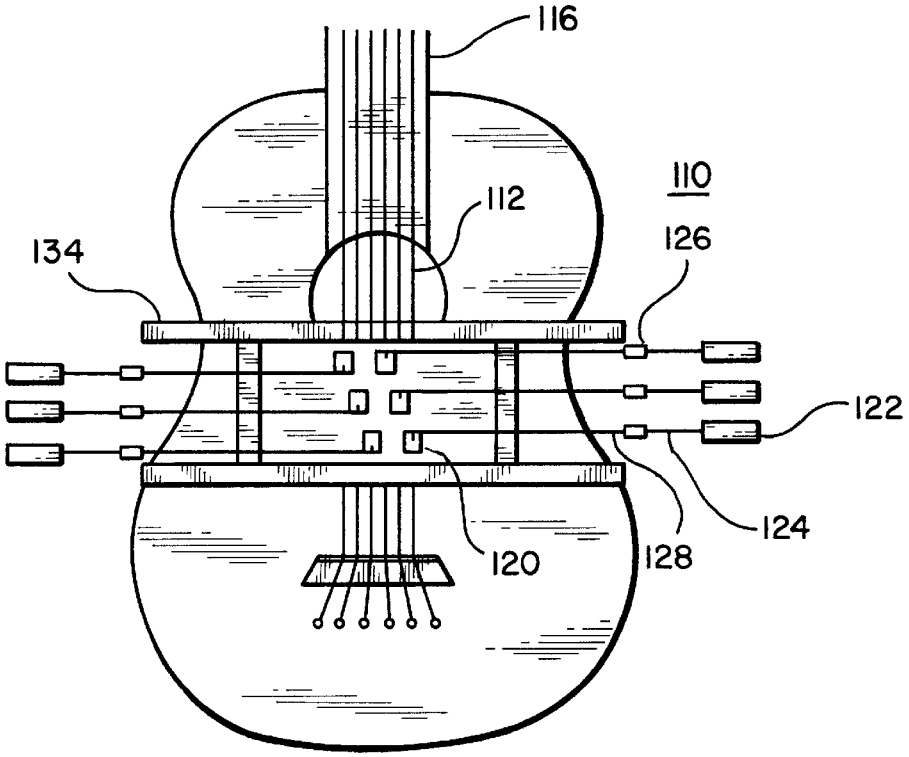
FIGS. 2*a–c* show a string plucking device of an automated stringed musical instrument according to the present invention.
Figure 2B:
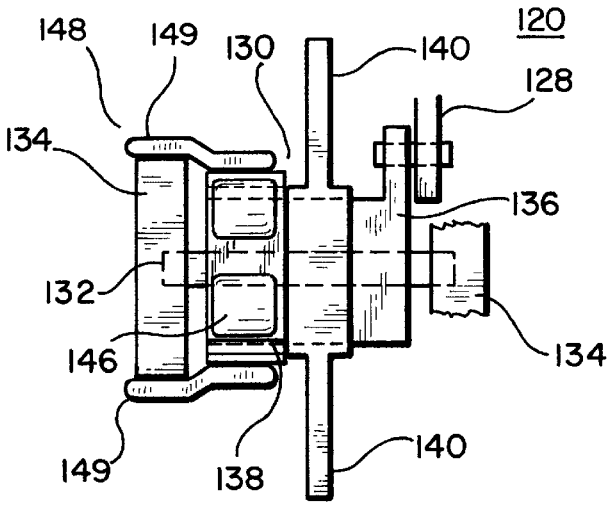
Figure 2C:
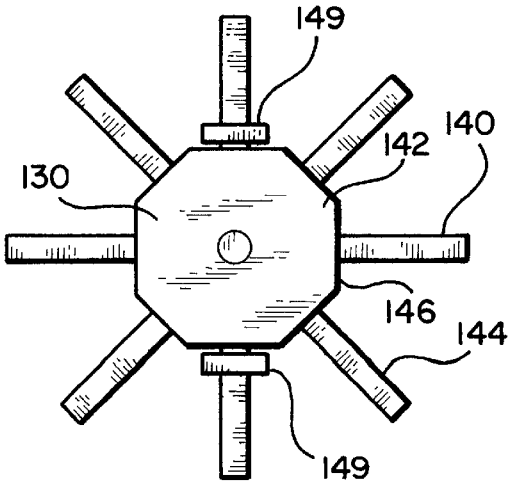

FIGS. 2*a–c* show an automated stringed musical instrument 100 including a string plucking device 110 for remotely plucking a string 112, according to the present invention. FIG. 2*a* is a plan view showing a string-contacting portion 120 rotationally indexed by an actuator 122. According to FIG. 2*a*, a separate string-contacting-portion 120 and associated actuator 122 are required to pluck each string 112. The actuator 122 is fixedly mounted relative to the neck 116 and includes an actuator arm 124 attached by a pivot 126 to a driving arm 128 in a manner well known to the skilled practitioner. Thus, the driving arm 128 is pivotally mounted for cyclic oscillating movement relative to the actuator 122, and therefore to neck 116 and attached strings 112.

Although the plucking arrangement is shown in connection with an instrument such as a guitar, banjo, or other stringed instrument with a neck such as 116, the plucking arrangement could also be used for a harp or other stringed instruments that do not have a neck.

In the preferred embodiment, an actuator signal causes energization of the actuator 122, which operatively pulls the actuator arm 124 and the attached driving arm 128 toward the actuator 122, thereby operatively pulling the string-contacting portion 120. Alternative embodiments (not shown) are envisioned, such as using a latching signal to close a latching relay which operatively energizes the actuator 122 so that the actuator 122 remains energized until unlatching signal opens the latching relay, thereby de-energizing the actuator 122.

FIG. 2*b* is a cross-sectional view showing the string-contacting portion 120 in greater detail. The wheel 130 preferably is made of plastic, for example injection moldable acetal resin, and is rotationally mounted relative to the driving arm 128 and the neck 116. This can be accomplished in any suitable manner known in the art, and preferably by mounting the wheel 130 by an axle 132 in a frame 134 disposed in a fixed location above the strings 112, so that the rotational axis of the wheel 130 is parallel to the longitudinal length of the strings 112. The driving arm 128 is pivotally attached to a plucker radius arm 136, which extends outward from an input shaft (not shown) of a one-way clutch 138 such that cyclic pivotal oscillating motion of the driving arm 128 in opposite directions is transmitted as periodic unidirectional rotation through the one-way clutch input shaft (not shown) to the one-way clutch output shaft (not shown), which is nested within and attached to the wheel 130. In the present invention, this is accomplished by the one-way clutch 138 being a roller-ramp type, or "Sprag" clutch, commonly known in the art and mounted so that it is rotationally connected to the wheel 130. The roller-ramp clutch preferably is a Torrington RC-104 series, manufactured by The Torrington Company, Torrington, Conn.

FIG. 2*c* shows a plurality of blades 140 arranged around an outer circumference 142 of the wheel 130 so that each blade 140 is oriented in a radial direction relative to the center of the wheel 130 and is parallel to the rotational axis of the wheel 130. Each blade has a free end 144 serving as a contact plucking portion (i.e., contacting the string to pluck it).

The wheel 130 is operatively associated with a respective string 112 such that a periodic unidirectional rotation of the wheel 130 causes each free end 144 to travel in an arc that intersects a respective string 112, so that after the free end 144 contacts and thereby displaces the string 112, the free end 144 releases the string 112, thereby plucking the string. The wheel 130 further includes plurality of contiguous flat surfaces 146 arranged around its outer circumference 142. Each intersection of adjacent flat surfaces 146 coincides with the location of a blade 140.

Ideally, in a first rotational direction, a one-way clutch will "lock-up" and convey any input shaft rotation through the clutch to the clutch output shaft, and in an opposite rotational direction, the clutch will "free-wheel" and convey no rotation to the clutch output shaft. In such an ideal case, each actuation would index the wheel 130, thereby causing each successive blade 140 to continue to move in the same rotational direction and no brake would be necessary to prevent counter-rotation. However, in a roller-ramp type one-way clutch, after locking up in a first direction, a modest amount of internal friction, or drag, may exist between the roller bearings and their respective angled ramps upon which each roller bearing locks-up under a first rotational direction. Thus, without a slight rotational drag feeding back through the clutch output shaft, the roller-ramp mechanism tends to stick in its locked condition. In a no-load situation, such as when the wheel is not attached to any rotational resistance, this "sticking" in the locked condition despite the fact that the input shaft direction is reversed, would simply drag the output shaft and wheel 130 backward in the same direction as the now-reversed input shaft. Of course, any substantial resistance, i.e., load on the output shaft, would overcome the sticking effect between rollers and respective ramps of the one-way clutch and would cause the rollers to unlock. Thus, it can be appreciated that because the output shaft is unloaded when it is not directly contacting a string 112, the small amount of internal friction in the clutch mechanism would drag the output shaft backwards every time the direction of the input shaft is reversed by the actuating arm 124. In the present invention, if this unimpeded reversal of the output shaft were to occur, a blade 140 would "back up" and contact the string 112, thereby causing unwanted acoustical effects. Therefore, a means for applying resistance to rotation of the wheel 130 is necessary to prevent unwanted reverse motion.

A braking device 148 that prevents unwanted reverse motion includes one or more flat resilient portions 149 arranged to resiliently press sequentially against each of the flat surfaces 146, as the wheel 130 rotates. In the preferred embodiment, the braking device 148 is made of plastic, for example injection moldable acetal resin, and is a pair of diametrically opposed flat portions 149 disposed around the wheel 130. While a single braking device 148 accomplishes the desired braking effect, the pressure exerted by one flat portion 149 in an inward radial direction forces the axle 132 away from its rotational axis. Consequently, a pair of flat portions 149, which are springs, located on opposite sides of the wheel 130 achieves a balance of the forces exerted by each portion on the axle 132. The pressure exerted by the braking device 148 against the wheel 130 is sufficient to overcome the above-described internal resistance of the one-way clutch and not only constrains the wheel to move in one direction, but also effectively indexes the wheel (each flat portion 149 sequentially abuts one of the eight surfaces 146), thereby ensuring relatively precise incremental movement of each blade 140 relative to a respective string 112.

The actuator 122 is any one of a pneumatic actuator, a vacuum actuator, an electric solenoid, a linear electric motor and a rotary electric motor. In the preferred embodiment, the actuator 122 is a pneumatic actuator.

Note that each plucking linkage 120 includes a driver arm 128 operably and movably connected to a contact plucking portion or free end 144. The driver arm 128 (which more generally may be called a driver member) and plucking portion 144 are movably connected in that the relative positions and/or orientations of the parts are not fixed as the arrangement performs the plucking. More specifically, the driver arm 128 is pivotably connected to the contact plucking portion 144 via plucker radius arm 136 and other intermediate parts. Therefore, the driver arm 128 is pivotably connected indirectly (i.e., via intermediate parts) to the contact plucking portion 144.

Figure 3A:
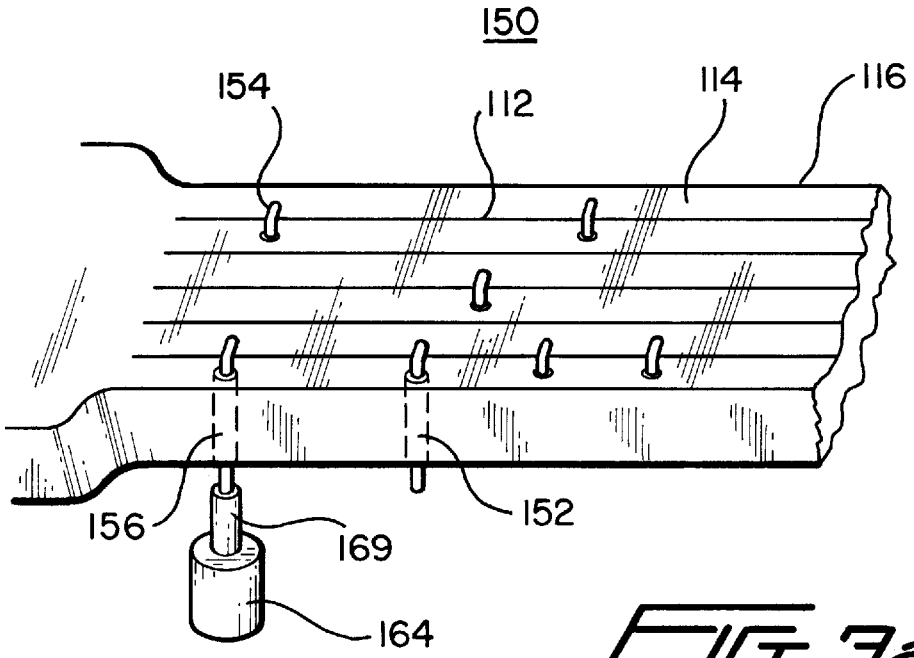
FIGS. 3*a,b* show a fretting device of an automated stringed musical instrument according to the present invention.
Figure 3B:
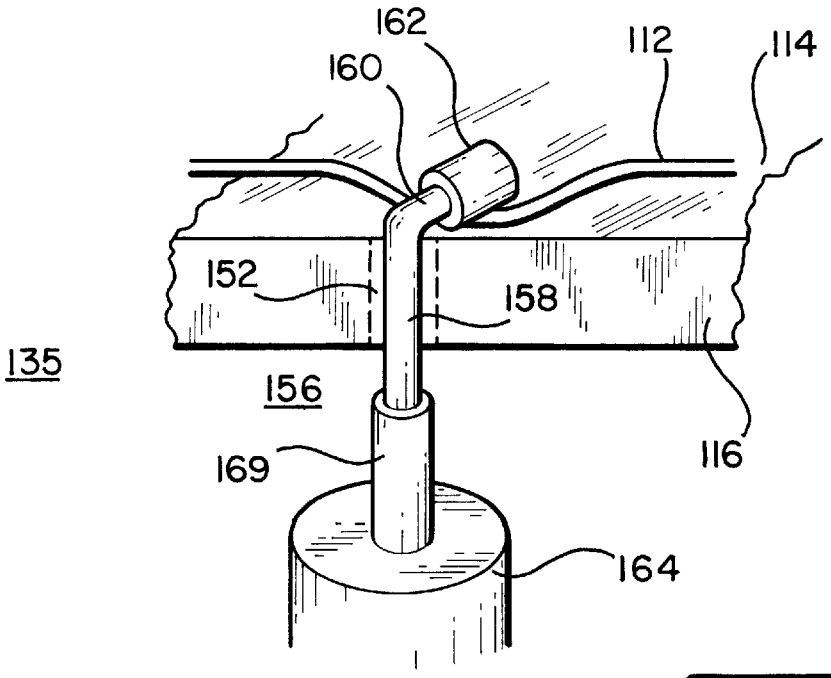

FIGS. 3*a,b* show a fretting device 150 of the present invention. As seen in FIG. 3a, the neck 116 includes a plurality of through-holes 152 oriented perpendicular to the surface 114 of the neck, each hole 152 being disposed near a string 112 and at spaced locations 154 along the neck 116. The locations or frets 154, are preferably located so that selected notes will sound when the string 112 is plucked while the string 112 is held tightly against the surface 114 at a fret 154. As shown in greater detail in FIG. 3*b*, a member 156 for holding the string 112 against the surface 114 is slidingly disposed within a respective through-hole 152 and each member 156 includes a rod portion 158 bob and a string-abutting portion 160 arranged to releasably draw a respective string 112 downward against the neck surface 114 and hold it there with a specified pressure. The member 156 preferably is a 1/16 inch diameter brass rod, although it can be made of any sized metal or plastic material that is strong enough to pull the string down and hold it against the surface 114 with the specified pressure. The string-abutting portion 160 preferably has a hooked shape. The hook shaped portion 160 preferably is an end portion formed at a right-angle relative to the longitudinal length of the rod portion 158. The hook shaped portion 160 includes a cushion portion 162, which preferably is a length of resilient rubber tubing encasing the hook, although any resilient material arranged to cushion the abutting surfaces of the string 112 and the hook shaped portion 160 will suffice. For example, the hook shaped portion 160 can be encased in rubber by dipping the portion 160 into the rubber when the rubber is in a liquid state.

FIGS. 3*a,b* also show actuator 164 having an actuator arm 169 drivingly attached to the member 156 in any manner commonly known to those skilled in the art, for example, by directly connecting the actuator arm 169 to the member 156 by mating threads (not shown). In the preferred embodiment, an actuating signal causes energization of the actuator 164, which operatively pulls the actuator arm 169 and the attached member 156 toward the actuator 148, thereby pulling the hook shaped portion 160 against a respective wire 112 and retaining the wire 112 between the cushion portion 162 and the surface 114 of the neck 116 at a specified pressure until the actuating signal is discontinued. Alternative embodiments (not shown) are envisioned, such as using a latching signal to close a latching relay which operatively energizes the actuator 164 so that the actuator 164 remains energized until an unlatching signal opens the latching relay, thereby de-energizing the actuator 164. Alternatively, the actuator 164 is located above a respective string 112 and depresses the string 112 downward, against the surface 114. In still another alternative embodiment, the member 156 is a rotating cam positioned above a respective string 112 that cycles a lobe past, and thereby depresses, the string 112.

The actuator 164 is any one of a pneumatic actuator, a vacuum actuator, an electric solenoid, a linear electric motor and a rotary electric motor. In the preferred embodiment, the actuator 164 is a pneumatic actuator.

Figure 4:
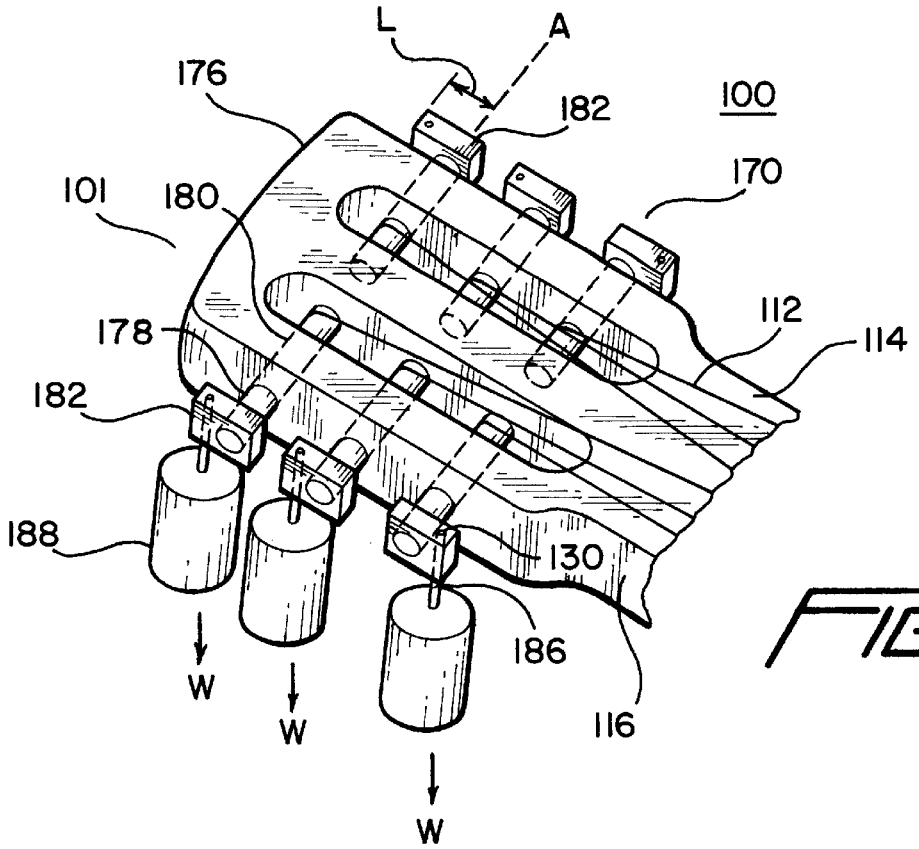
FIG. 4 shows a string tension-maintaining device of an automated stringed musical instrument according to the present invention.

FIG. 4 shows a string tension-maintaining device 170 located in an end of an automated stringed musical instrument 100, according to the present invention. The end 176 of instrument 100 shown in FIG. 4 corresponds to the end 26 of the instrument 10 shown in FIG. 1. In the instrument 100, strings 112 are held in tension above a longitudinal surface 114 of an underlying neck 116. The strings 112 are anchored to a first end (not shown) opposite the end 176 and are attached to respective shafts 178 arranged to be rotationally anchored at the end 176 of the instrument 100. The shafts 178 are retained in respective through-holes 180 in the neck 116 so that they may independently, freely rotate. Preferably, the shafts 178 are sleeved by roller bearings (not shown), which are retained in the through-holes 180. Each shaft 178 has an attached radius arm 182 having a free end 184. A rod 186 is attached to the free end 184 at a distance L from the axis of rotation A of the shaft 178. As illustrated in FIG. 4, the other end of the rod 186 is attached to a weight 188 of a specified weight W, which pulls the end of the rod 186 in a downward direction. As a skilled practitioner would appreciate with reference to FIG. 4, the weight 188 is attached to the rod 186 so that the weight W times the radius arm length L applies a torque of W times L to the shaft 178.

As one skilled in the art will appreciate, a resulting tension will thereby be developed in the attached string 112. The rod 186 alternatively is a wire or cable and can be made of any material including plastic or metal that is strong enough to withstand the tension and other forces due to the angle between the weight 188 and the radius arm 182. The tension of each string 112 can be set to a predetermined, individual value by selecting a value W for a weight 184. The weights 184 tend to hold the strings 112 at constant tension so that changes in temperature, humidity, etc. will not cause the string to tighten or loosen. By maintaining the tension constant or substantially constant, the strings are kept in tune.

Other alternative arrangements (not shown) are envisioned in which shafts 178 are arranged so that the attached weights 184 are attached by wires 186 instead of rods 186 and are located remotely from the neck 116. For example, each shaft 178 can be oriented at a selected angle to the longitudinal surface 114 of the neck 116 and each respective wire 186 can be reeved over one or more pulleys (not shown) so that each respective weights 184 hang freely at any selected location relative to the neck 116.

The strings 112 of the automated stringed musical instrument can be made to produce sound by any combination of three methods which produce different levels of sound. One method that achieves the loudest volume of sound involves plucking the strings 112 in accordance with the above-described cooperation between the blades 140 and the strings 112. A second method achieves a volume level that is half that of the plucking method by rapidly fretting the strings 112, wherein a rapid impact of a cushion portion 162 against a string 112 causes the string 112 to vibrate, thereby producing a relatively soft sound. The third method muffles the response of a plucked string when a cushion portion 162 is pressed against a string 112 at a point close to the bridge (not shown) of the instrument, where the bridge is defined as a string support portion located near the end of the neck opposite to where each string is attached to a respective tensioning linkage. Varying levels of volume can be achieved by various combinations of these three methods, and refinements in the timing, extent and duration of pressure on the string can result in subtle acoustic effects important to the production of music.

Figure 5A:
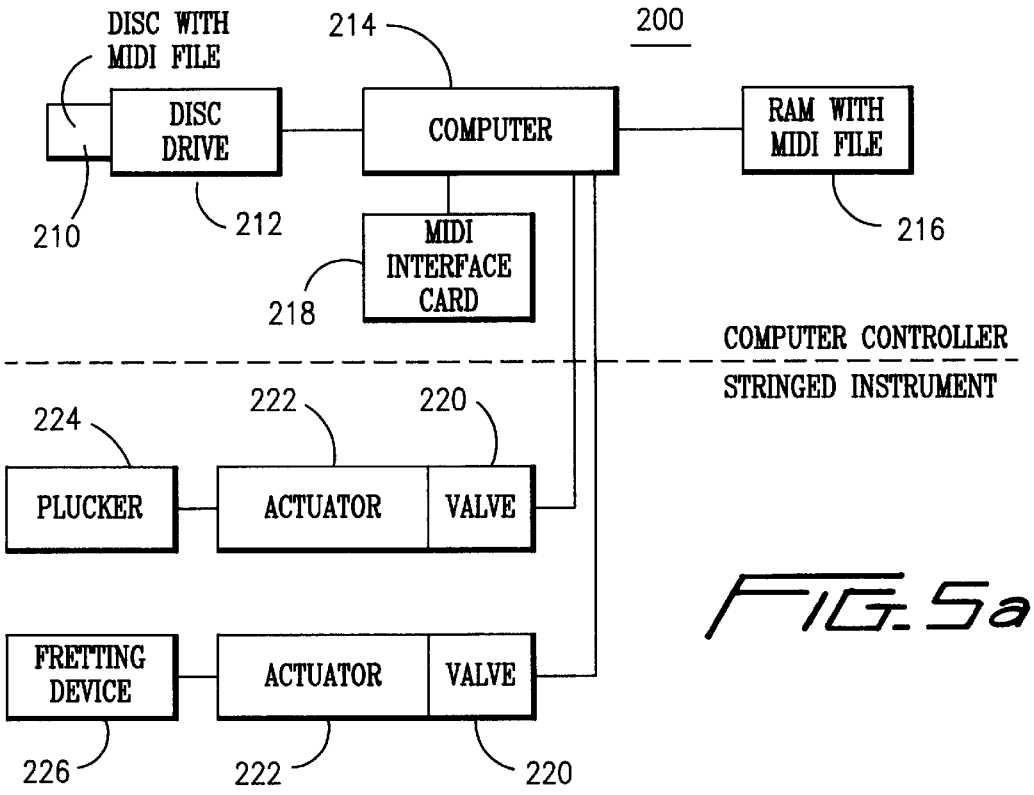
FIGS. 5*a,b* show block diagrams of the present invention as applied to a computer-based control and a paper tape-based control, respectively.

FIGS. 5*a,b* show a block diagram of the present invention, including a remotely controlled reader for reading a set of pre-recorded instructions connected to an actuating device that operates a plucker for plucking the strings of a stringed musical instrument. FIG. 5*a* shows a computer-based arrangement 200 of the present invention that includes a computer controller portion separate from, but electrically connected to, a stringed instrument portion. The computer controller portion includes set of stored instructions stored as a MIDI file on a computer disc 210 that is readably coupled to a disc drive 212, which is connected to a computer 214, which includes a random access memory 216, commonly known as RAM, which temporarily stores the MIDI file during processing by the computer 214. The computer 214 further includes a MIDI interface card 218 which enables the computer to electronically communicate with the stringed instrument, which includes electrically controlled valves 220 operatively connected to actuators 222, which in turn are mechanically connected to string plucking devices 224. Other actuators 222 are mechanically connected to string fretting devices 226. Individual devices 222–226 are respectively associated with all of the strings.

Figure 5B:
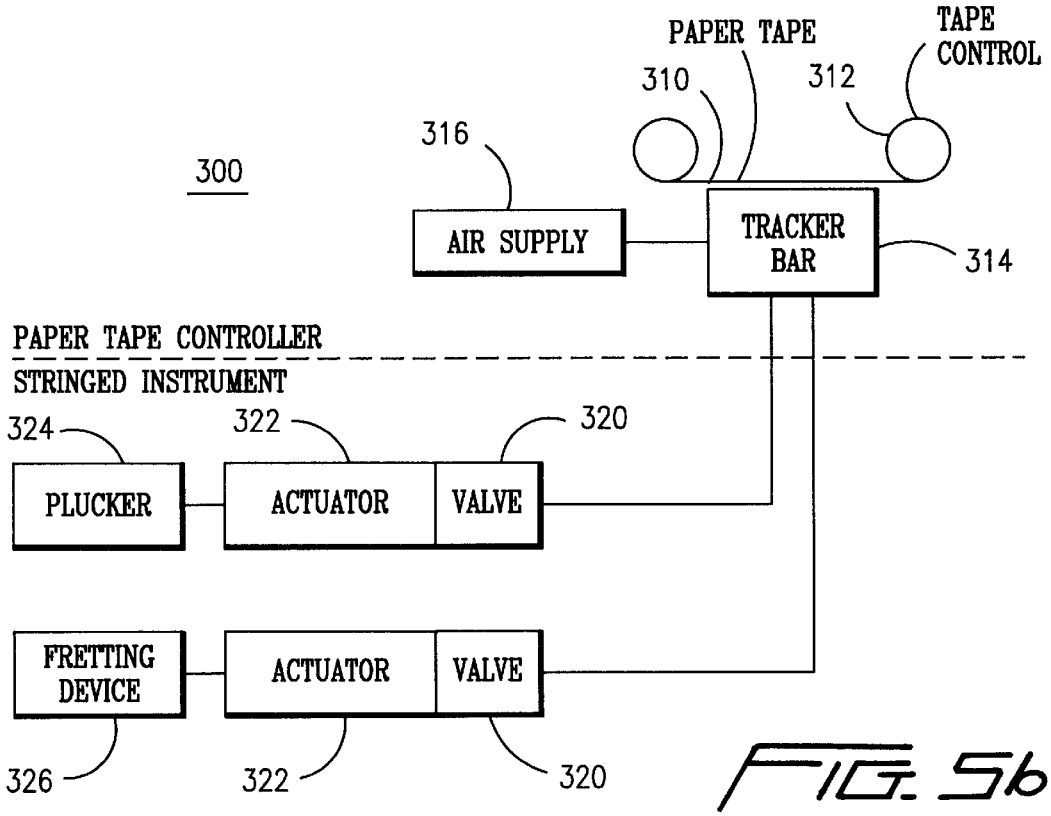

FIG. 5*b* shows a paper tape-based arrangement 300 of the present invention that includes a paper tape controller portion separate from, but pneumatically connected to, a stringed instrument portion. The paper tape controller portion includes set of stored instructions stored as a pattern of holes on a paper tape 310, that are moved by a tape control 312 over sensing holes of a tracker bar 314 powered by an air supply 316, where the holes in the paper tape are pneumatically sensed by the tracker bar 314. The tracker bar 314 delivers the pneumatic signal to the valves 320 which are operatively connected to actuators 322, which in turn are mechanically connected to string plucking devices 324. Other actuators 322 are mechanically connected to string fretting devices 326. Individual devices 322–326 are respectively associated with all of the strings.

Figure 6:
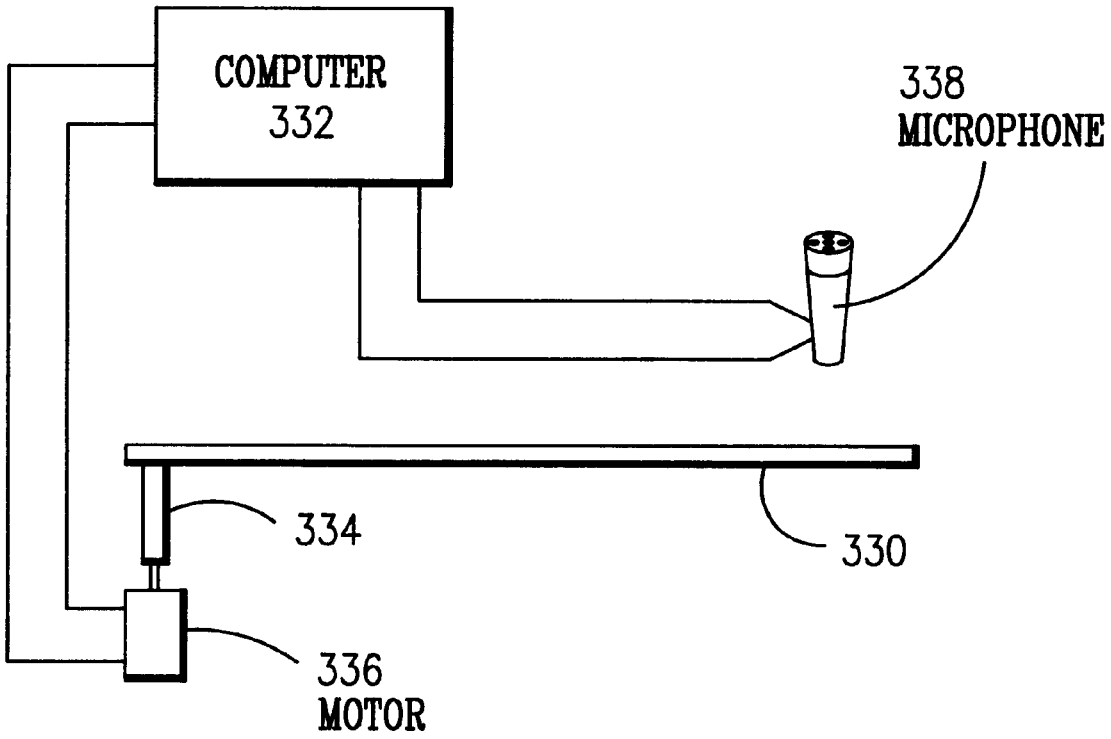
FIG. 6 is a simplified schematic of an alternate automatic tuning arrangement which may be used instead of the string tension-maintaining device of FIG. 4.

FIG. 6 will be used to explain an alternate automatic tuning arrangement to that of FIG. 4. A string 330 is shown with an arrangement to automatically tune the string by using a computer 332. Although not shown in FIG. 6, the string 330 would have automatic plucking and automatic fretting arrangements under the control of computer 332 as discussed above. The string 330 has a worm gear 334 as commonly used on string instruments. However, instead of manually tuning string 330 by manually causing rotation of the worm gear 334 as common in past designs, a small electric motor 336 drives the worm gear to different angular positions to tighten or loosen the string as necessary to maintain it in tune. The motor is connected to computer 332 (either directly as shown or by way of an unshown interface or driver) such that computer 332 controls the string tension. At a prescribed time interval, such as once a day or more often, the computer 332 plucks string 330 (by the plucking arrangement discussed above, but not shown in FIG. 6). Microphone 338 picks up the sound and inputs it to computer 332. The computer compares the sensed sound with a stored value representing the ideal sound of that string. If the sensed sound is different than the desired sound, the computer 332 signals motor 336 to tighten or loosen the string 330 in order to bring it into tune. The string may be plucked repeatedly if necessary or desirable to allow the computer 332 to tune the string via the control feedback loop realized by this arrangement.

It will be apparent to those skilled in the art that various modifications and variations can be made in the structure of the automated stringed musical instrument of the present invention without departing from the scope or spirit of the invention. Thus, it is intended that the present invention cover the modifications and variations of the invention provided they come within the scope of the appended claims and their equivalents.

What is claimed is:

1. An automated stringed musical instrument comprising:

tone-sounding strings held in lengthwise tension; and a plurality of plucking linkages, each operable to selectively releasably contact and displace a corresponding one of the strings so that the corresponding string vibrates and thereby produces a sound, and wherein each plucking linkage includes a driver member operably connected to a contact plucking portion such that there is relative movement between the driver member and the contact plucking portion.

2. The automated stringed musical instrument of claim 1 wherein the driver member of each plucking linkage is pivotably connected to a contact plucking portion.

3. The automated stringed musical instrument of claim 1 wherein the driver member of each plucking linkage is pivotably connected indirectly to a contact plucking portion.

4. The automated stringed musical instrument of claim 1 wherein the driver member of each plucking linkage provides cyclic oscillating movement.

5. The automated stringed musical instrument of claim 4 wherein the cyclic oscillating movement of each driver member causes rotation in a single direction of the corresponding contact plucking portion.

6. The automated stringed musical instrument of claim 1 wherein each plucking linkage includes a plurality of contact plucking portions, the driver member of a given plucking linkage being operably and movably connected to all of the plurality of contact plucking portions of the given plucking linkage such that the contact plucking portions of the given plucking linkage in turn contact the corresponding string.

7. An automated stringed musical instrument plucking linkage comprising:

an actuator;

a string-contacting portion rotationally indexed by the actuator, and wherein said string-contacting portion further comprises:

a driving arm pivotally mounted relative to said strings for cyclic oscillating movement;

a wheel rotationally mounted relative to said driving arm and connected to said driving arm through a one-way clutch such that cyclic pivotal oscillating motion of the driving arm in opposite directions is transmitted to the wheel as periodic unidirectional rotation through said one-way clutch;

a plurality of blades arranged around an outer circumference of said wheel, each being blade oriented in a radial direction relative to a center of the wheel and being parallel to a rotational axis of said wheel, each blade having a free end;

said wheel being operatively associated with a respective string such that the periodic unidirectional rotation of the wheel causes each said free end to travel in an arc that intersects the corresponding string so that after said free end contacts and thereby displaces the string, said free end releases the string; and a braking device arranged to resist rotational movement of said wheel.

8. The automated stringed musical instrument plucking linkage of claim 7, wherein said wheel further comprises a plurality of contiguous flat surfaces arranged around said outer circumference, and said braking device comprises:

at least one flat resilient portion arranged to resiliently press sequentially against each of said flat surfaces as said wheel rotates.

9. The automated stringed musical instrument plucking linkage of claim 7 mounted to a stringed musical instrument with the string contacting portion operable to pluck a string of the stringed musical instrument.

10. An automated stringed musical instrument comprising:

tone-sounding strings held in lengthwise tension, a plurality of plucking linkages, each operable to selectively releasably contact and displace a corresponding one of the strings so that the corresponding string vibrates and thereby produces a sound, and a string-contacting portion rotationally indexed by an actuator, and a braking device arranged to resist movement of at least a part of the string contacting portion.

11. An automated stringed musical instrument of claim 10 wherein the strings extend along a surface of a neck and further comprising a fretting linkage arranged to selectively releasably abut and displace a respective string so that a predetermined pressure is applied to press said respective string against said surface.

12. The automated stringed musical instrument of claim 11, wherein said fretting linkage comprises:

said neck having a plurality of through-holes oriented perpendicular to said surface thereof, each hole disposed near a string and at spaced locations along said neck; and a plurality of members each slidingly disposed within a respective through-hole, each said member having a string-abutting portion arranged to releasably draw a respective string downward against said neck surface.

13. The automated stringed musical instrument of claim 12, wherein said string-abutting portion is a hook-shaped portion having a string-contacting cushioning surface.

14. An automated stringed musical instrument of claim 11 further comprising a tensioner attached to each respective string and wherein each tensioner is operable to maintain the respective string in tune, each tensioner operable to control a portion of the respective string subject to vibration and selected from the group consisting of: a motor and a weight.

15. The automated stringed musical instrument of claim 10, wherein said string-contacting portion further comprises:

a driving arm pivotally mounted relative to said respective string for cyclic oscillating movement;

a wheel rotationally mounted relative to said driving arm and connected to said driving arm through a one-way clutch such that cyclic pivotal oscillating motion of the driving arm in opposite directions is transmitted to the wheel as periodic unidirectional rotation through said one-way clutch;

a plurality of blades arranged around an outer circumference of said wheel, each being blade oriented in a radial direction relative to a center of the wheel and being parallel to a rotational axis of said wheel, each blade having a free end;

said wheel being operatively associated with a respective string such that the periodic unidirectional rotation of the wheel causes each said free end to travel in an arc that intersects the corresponding string so that after said free end contacts and thereby displaces the string, said free end releases the string; and wherein the braking device is arranged to resist rotational movement of said wheel.

16. The automated stringed musical instrument of claim 15, wherein said wheel further comprises a plurality of contiguous flat surfaces arranged around said outer circumference, and said braking device comprises:

at least one flat resilient portion arranged to resiliently press sequentially against each of said flat surfaces as said wheel rotates.

17. The automated stringed musical instrument of claim 10 wherein each plucking linkage includes a driver member operably and movably connected to a contact plucking portion.

18. The automated stringed musical instrument of claim 17 wherein the driver member of each plucking linkage is pivotably connected to a contact plucking portion.

19. The automated stringed musical instrument of claim 17 wherein the driver member of each plucking linkage provides cyclic oscillating movement.

* * * * *